US007189065B2

(12) United States Patent
Dudley

(10) Patent No.: US 7,189,065 B2
(45) Date of Patent: Mar. 13, 2007

(54) COMPRESSOR HEAT REGENERATIVE SYSTEM

(75) Inventor: Kevin F. Dudley, Cazenovia, NY (US)

(73) Assignee: Carrier Corporation, Farmington, CT (US)

( * ) Notice: Subject to any disclaimer, the term of this patent is extended or adjusted under 35 U.S.C. 154(b) by 457 days.

(21) Appl. No.: 10/616,192

(22) Filed: Jul. 9, 2003

(65) Prior Publication Data

US 2005/0008503 A1 Jan. 13, 2005

(51) Int. Cl.
*F01M 5/00* (2006.01)
*F04B 23/00* (2006.01)

(52) U.S. Cl. ..... 417/313; 165/10; 165/902; 184/6.22

(58) Field of Classification Search ..... 184/6.22; 417/313; 165/10, 902
See application file for complete search history.

(56) References Cited

U.S. PATENT DOCUMENTS 2,285,720 A * 6/1942 Septer ..... 184/104.2
3,114,360 A * 12/1963 Snelling ..... 184/6.22
3,339,829 A * 9/1967 Connor ..... 417/295
4,181,474 A * 1/1980 Shaw ..... 417/366
4,817,704 A * 4/1989 Yamashita ..... 165/10
4,924,818 A * 5/1990 Linden ..... 123/198 E
4,982,722 A * 1/1991 Wyatt ..... 220/574.2
5,159,910 A * 11/1992 Ninomiya et al. .... 123/196 AB

FOREIGN PATENT DOCUMENTS

JP 2002-277068 * 9/2002

* cited by examiner

*Primary Examiner*—Michael Koczo, Jr.
(74) *Attorney, Agent, or Firm*—Ohlandt, Greeley Ruggiero & Perle, L.L.P.

(57) ABSTRACT

A regenerative source of heat is provided for the oil used to lubricate a compressor within a heating, cooling or refrigeration system. The regenerative source absorbs heat from the oil when it is circulating through the compressor at a relatively high temperature. The regenerative source gives up heat to the oil following deactivation of the compressor. The source of heat includes a thermal phase change material that is preferably a hydrated salt capable of storing sufficient thermal energy to maintain the oil above any temperatures that would cause damage to the moving parts of the compressor.

5 Claims, 5 Drawing Sheets

COMPRESSOR HEAT REGENERATIVE SYSTEM

BACKGROUND OF THE INVENTION

This invention relates to the protection of compressors in heating, cooling, or refrigeration systems. In particular, this invention relates to apparatus for protecting these compressors from adverse environmental conditions.

Compressors in heating, cooling, or refrigeration systems may have to operate in less than optimal environments. For example, a compressor in a heat pump may be required to provide heat to an interior space when the compressor is operating in a cold outside environment. There may also be situations in which cooling is required of an interior space when the compressor is operating in an outside temperature environment that is rather cold. An example of an even harsher environment for a compressor can be found in situations experienced by a transport refrigeration system. These latter systems are often called upon to cool or refrigerate a cargo being transported by a truck, train locomotive or other transport means in a variety of adverse weather conditions.

The oil used to lubricate these compressors is particularly vulnerable to such cold environments since it may become quite viscous at low temperature if the compressor has not been operated for a significant period of time. The oil might also be holding refrigerant picked up from various parts of the compressor. Circulating this oil through the compressor can cause damage to the compressor. In this regard, the oil will not properly lubricate critical parts of the compressor causing them to deteriorate much faster than would otherwise be the case.

Heretofore, the lubricating oil has been maintained at an appropriate temperature by various electrical heating devices either mounted inside or outside of the housing that holds the oil. This housing is often referred to as the crankcase in many compressor configurations. These heating devices consume electrical energy when electrical current flows in the circuits associated with these devices. These heating devices moreover may not operate properly from time to time due to a breakdown in the circuit carrying the electrical current.

It would be preferable to have a source of heat that would not require a significant amount of energy. It would furthermore be preferable that the source of heat not be susceptible of breaking down at a critical time when a demand is being placed on the compressor by the heating, cooling, or refrigeration system.

SUMMARY OF THE INVENTION

The present invention provides a regenerative source of heat for the oil used to lubricate a compressor. The regenerative source absorbs heat from the oil when it is circulating through the compressor at a relatively high temperature. The regenerative source gives up heat to the oil following the deactivation of the compressor and the subsequent cooling down of the oil.

In a preferred embodiment, the regenerative heat source is a unit in contact with the exterior of the crankcase portion of the compressor. The unit contains a thermal phase change material that absorbs heat from the oil when it is circulating through the compressor and gives up heat to the oil following deactivation of the compressor. The thermal phase change material is preferably a hydrated salt capable of storing sufficient thermal energy to maintain the oil at appropriate temperature levels. The unit preferably slides into engagement with the crankcase and is fastened thereto in a manner that allows for subsequent easy removal for examination and possible replacement.

In an alternative embodiment, the unit of thermal phase change material is positioned within the crankcase itself. In either embodiment, heat is released from the thermal phase change material when the compressor shuts off and cools down. The heat released by the phase change material will boil off any refrigerant that may accumulate in the crankcase. The released heat will also insure that any refrigerant in the oil is boiled off and that the oil will have an ample viscosity when the compressor is turned on again.

DESCRIPTION OF THE PREFERRED EMBODIMENT

Figure 1:
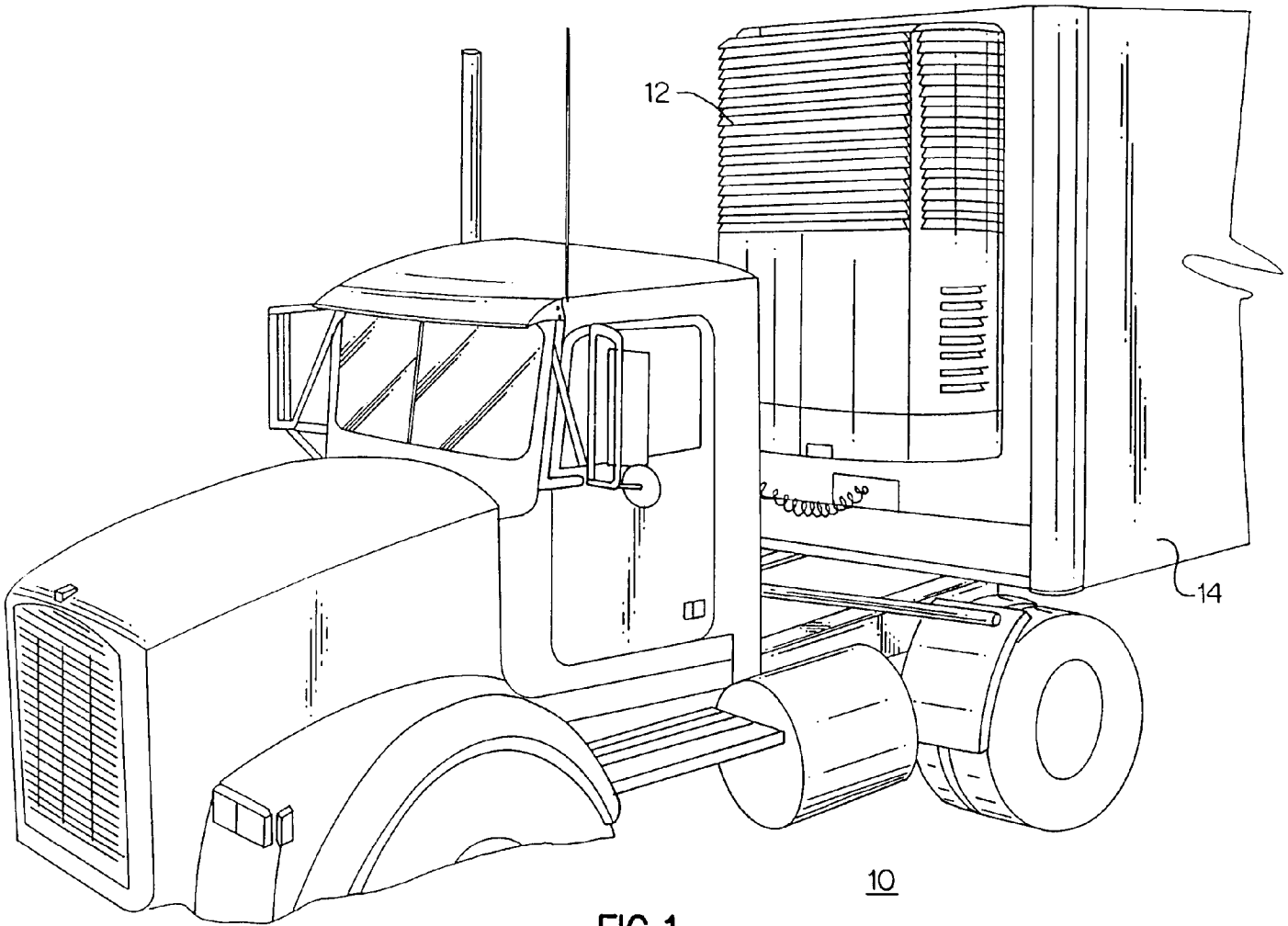
FIG. 1 is a view of a truck trailer unit having a transport refrigeration unit mounted to the front of the trailer.

Referring to FIG. 1, a truck trailer unit 10 is seen to include a transport refrigeration unit 12 affixed to the front of the trailer 14. The transport refrigeration unit 12 will maintain the temperature within the interior of the trailer 14 depending on the cargo being transported. In order to do so, a compressor within the transport refrigeration unit 12 will be responding to various levels of demand for heating, cooling or refrigeration in many different operating environments.

Figure 2:
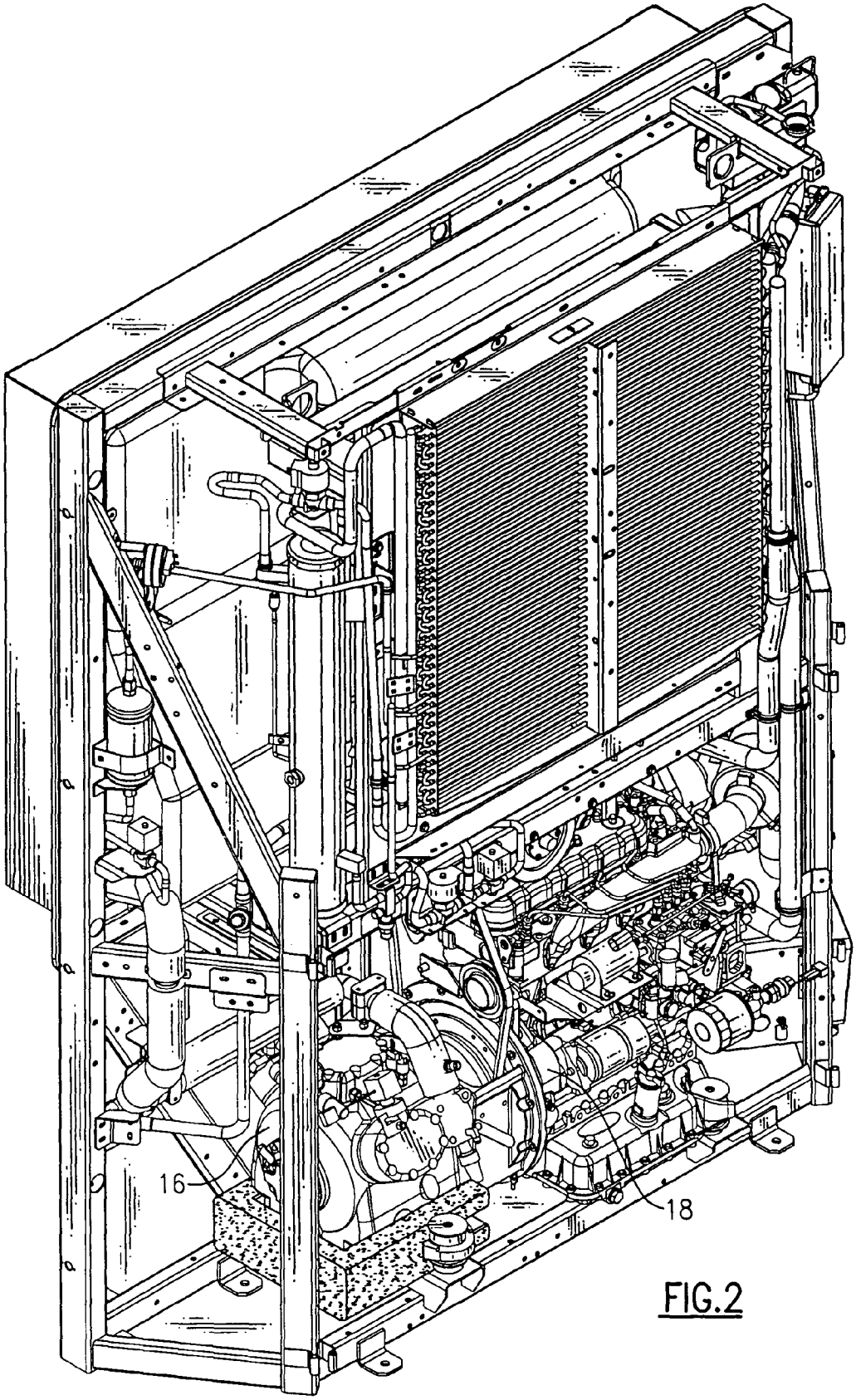
FIG. 2 is a view looking into the interior of the transport refrigeration unit of FIG. 1.

Referring to FIG. 2, the compressor 16 within the transport refrigeration unit 12 is driven by a diesel engine 18 so as to compress refrigerant for subsequent circulation through heat exchangers within the unit. One of these heat exchangers, when functioning as an evaporator, will extract heat from air forced through the heat exchanger and into the interior of the trailer 14. The unit 12 may also cause a heat exchanger functioning as a condenser to introduce heat into the air moving into the interior of the trailer.

Figure 3:
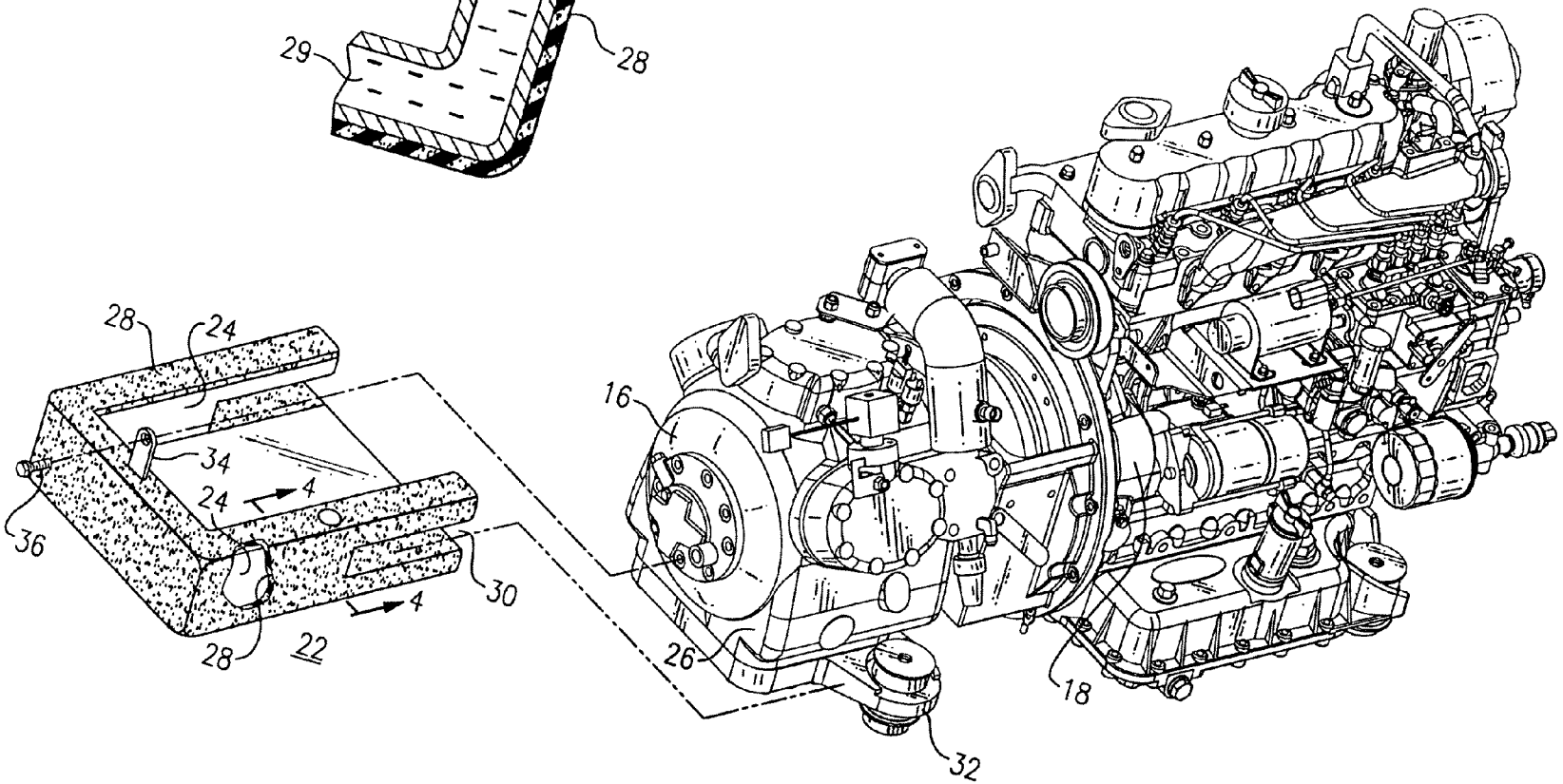
FIG. 3 is a view of a compressor within the transport refrigeration unit and a heat regenerative unit that is to be positioned with respect to the crankcase of the compressor.
Figure 4:
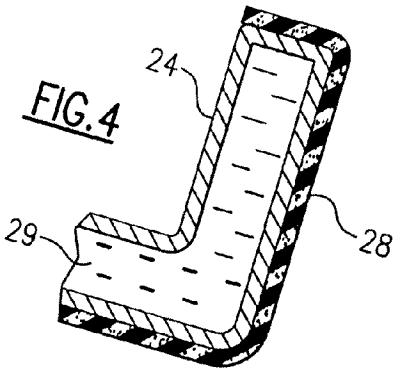
FIG. 4 is a cross sectional view of a portion of the heat regenerative unit of FIG. 3.

Referring to FIG. 3, a heat regenerative unit 22 is illustrated relative to the compressor 16. The heat regenerative unit 22 consists of a containment vessel 24 preferably formed from a material that allows heat to be transferred to and from a housing 26 that holds the oil for lubricating moving parts of the compressor 16. In particular, the interior portions of the containment vessel 24 are preferably in contact with the exterior of the housing 26 so as to define an efficient heat transfer relationship. The heat regenerative 22 unit also includes insulation 28 covering those portions of the containment vessel 24 not having a direct heat transfer relationship with the housing 26. This housing is often referred to as the crankcase for the compressor 16. The oil within the housing 26 may from time to time accumulate refrigerant. It is important that any such refrigerant be boiled off Referring to FIG. 4, the containment vessel 24 of the heat regenerative unit includes a thermal phase change material 29 that will provide an appropriate amount of heat to the oil within the housing 24 during extreme conditions. These conditions will include the maximum anticipated amount of time that the compressor 16 would not be running in a particularly cold environment. An illustrative set of conditions might be a transport refrigeration unit being shut down overnight for a period of twelve hours during which the outside temperature is minus eighteen degrees Centigrade. The thermal phase change material would need to have sufficient heat absorption and dissipation properties to maintain the oil above an appropriate temperature. This temperature would be above the boiling point of the refrigerant being operated upon by the compressor. An example of such a thermal phase change material is hydrated salt having a melting point of fifty-eight degrees Centigrade and a sixty watt-hour energy storage capability per kilogram. Such a salt is available from a variety of sources, including PCM Thermal Solutions of Naperville, Ill. One kilogram of this hydrated salt phase change material provides one and one half hours of equivalent heat from an electrical resistance heater for a normal size crankcase holding 3.7 liters of oil in a transport refrigeration unit. To provide effective crankcase heat for a twelve-hour overnight shutdown of the compressor when the outside temperature is minus eighteen degrees Centigrade, the heat regenerative unit would need at least eight kilograms of the aforementioned hydrated salt phase change material. Accordingly, the heat regenerative unit would need to be sized to hold approximately eight kilograms of the aforementioned hydrated salt phase change material plus an additional amount that will need to be computed based on the efficiency of the heat transfer through the walls of the containment vessel 24 and the housing 26 for the oil.

It is to be appreciated that the heat regenerative unit containing the thermal phase change material may be of almost any shape as long as it contains sufficient thermal phase change material and provides sufficient heat transfer through the walls of both the containment vessel 24 and the housing 26. To maximize the heat transfer efficiency, the containment vessel 24 is preferably fabricated from aluminum or a plastic having a relatively high heat transfer coefficient. An example of such a plastic would be a liquid crystal polymer identified as E200 LCP available from Cool Polymers Inc of Warwick, R.I. The heat regenerative unit may also include geometry that allows it to be easily mounted to the crankcase portion of the compressor. For example, slots such as 30 allow the heat regeneration unit to engage compressor mounts such as 32 extending from the housing 26. The heat regenerative unit may also include an upwardly extending tab 34 that accommodates a threaded fastener 36 that engages a mounting hole in the compressor.

Figure 5:
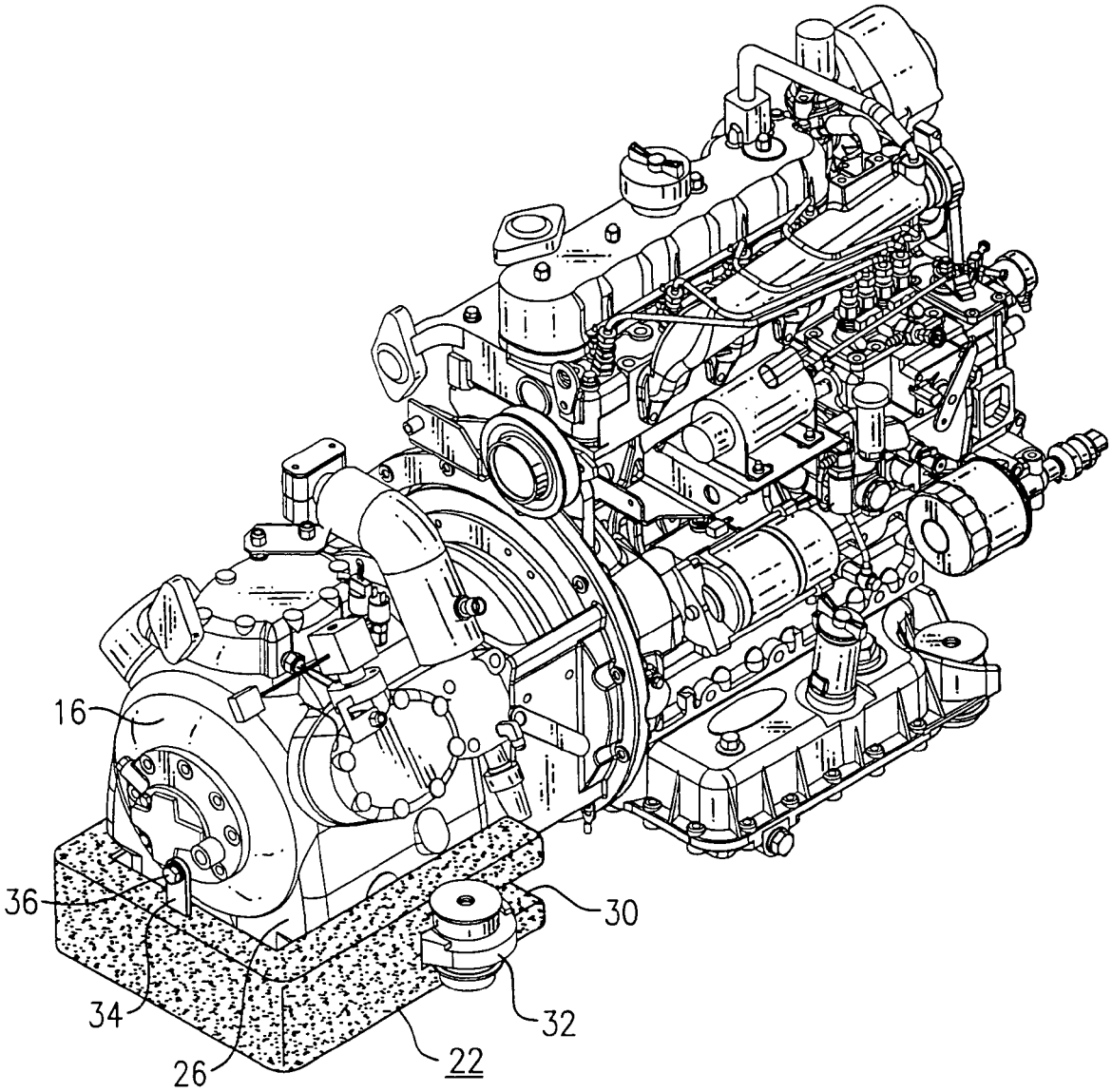
FIG. 5 is a view of the heat regenerative unit in position with respect to the crankcase of the compressor.

Referring to FIG. 5, the heat regenerative unit 22 is illustrated in mounted position relative to the housing 26. In this regard, the slots such as 30 engage the compressor mounts such as 32 extending from the housing 24. The upwardly extending mounting tab 34 allows for threaded engagement of the fastener 36 with a mounting hole in the front of the compressor 16.

Figure 6:
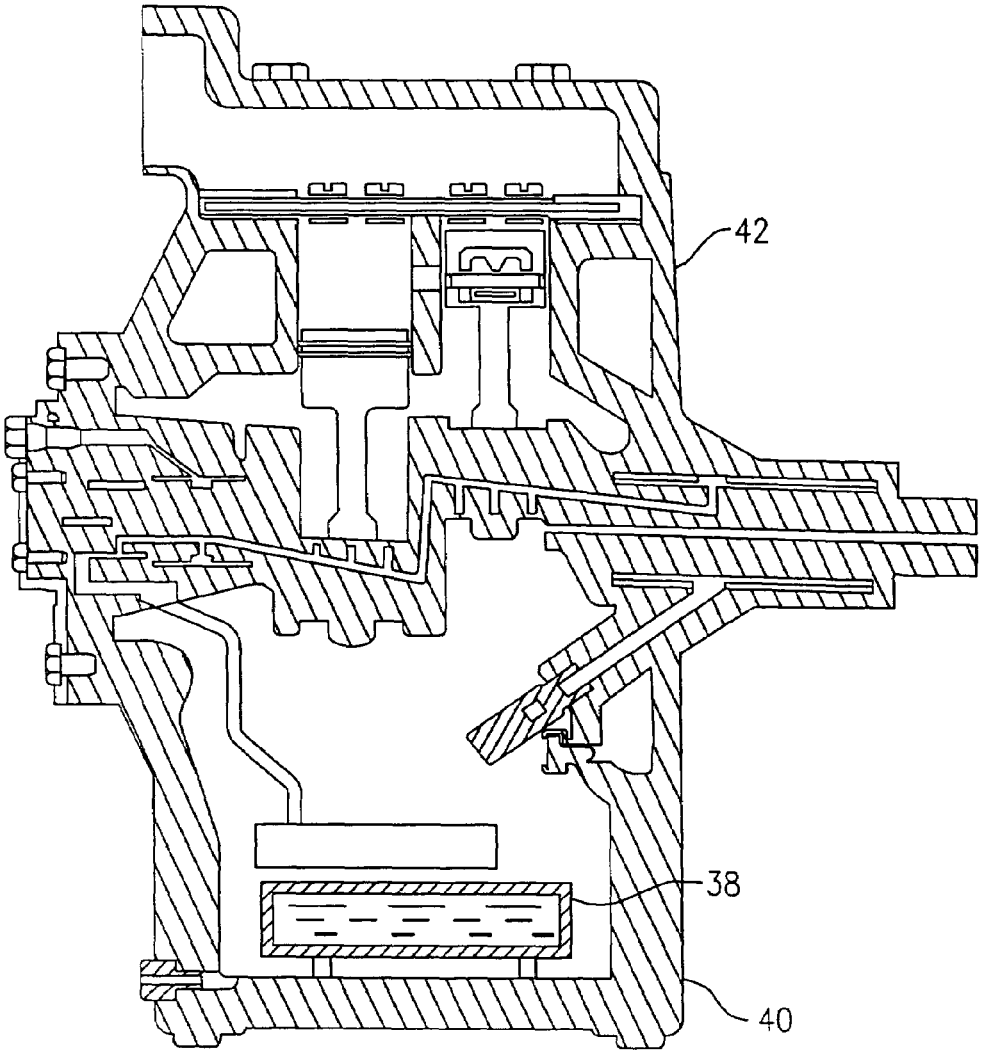
FIG. 6 is a view of an alternatively positioned heat regenerative unit within the interior of a crankcase of a compressor.

Referring to FIG. 6, a heat regenerative unit 38 is positioned within the interior of a crankcase 40 associated with a compressor 42. The heat regenerative unit 38 is preferably fabricated from the same materials as previously discussed for the containment vessel 24. To maximize heat transfer efficiency, the heat regenerative unit 38 is preferably mounted above the bottom of the crankcase 40. It is to be appreciated that the heat regenerative unit 38 will have a higher overall heat transfer efficiency than that of the heat regenerative unit 22. Accordingly, the heat regenerative unit 38 will be of less size and contain less thermal phase change material than what would be required for the heat regenerative unit 22.

It is to be appreciated that a number of embodiments of a heat regenerative unit for the crankcase of a compressor have been disclosed. It will be appreciated by those skilled in the art that further changes could be made to the above-described embodiments without departing from the scope of the invention. For instance, the heat regenerative unit could be used in other types of heating or cooling systems other than transport refrigeration. Accordingly, the foregoing description of various embodiments of the heat regenerative unit is by way of example only and the invention is to be limited only by the following claims and equivalents thereto.

What is claimed is:

1. Apparatus for protecting a compressor within a heating, cooling, ventilating or refrigeration system wherein the compressor includes a housing for the oil used to lubricate moving parts of the compressor, said apparatus comprising: a heat regenerative unit containing material that absorbs heat from the oil when the oil is lubricating moving parts of the compressor in an operational state, said material transferring the absorbed heat back to the oil when the compressor is no longer in an operational state whereby the oil is maintained at a temperature level sufficient to avoid damage to moving parts of the compressor, wherein portions of the heat regenerative unit are in contact with the exterior of the housing for the oil used to lubricate moving parts of the compressor, and wherein the portions of the heat regenerative unit not in contact with the housing for the oil are insulated.

2. The apparatus of claim 1 wherein the portions of the heat regenerative unit in contact with the exterior of the housing for the oil are in contact with at least three sides of the exterior of the housing.

3. The apparatus of claim 1 wherein the material that absorbs heat from the oil and transfers the absorbed heat back to the oil is a thermal phase change material having a melting point above a minimum desired temperature for the oil when the compressor is no longer in an operational state.

4. The apparatus of claim 1 wherein material that absorbs the heat from the oil and transfers the heat back to the oil is a hydrated salt capable of maintaining the temperature of the oil above a point needed to boil off any refrigerant in the oil.

5. The apparatus of claim 1 wherein the heat regenerative unit is fabricated from aluminum.

* * * * *